US008783173B2

(12) United States Patent
Schwelling

(10) Patent No.: US 8,783,173 B2
(45) Date of Patent: Jul. 22, 2014

(54) DEVICE FOR COMPRESSING OF EMPTY DEFORMABLE CONTAINERS

(76) Inventor: Hermann Schwelling, Salem (DE)

( * ) Notice: Subject to any disclaimer, the term of this patent is extended or adjusted under 35 U.S.C. 154(b) by 359 days.

(21) Appl. No.: 12/584,711

(22) Filed: Sep. 10, 2009

(65) Prior Publication Data

US 2010/0058942 A1 Mar. 11, 2010

(30) Foreign Application Priority Data

Sep. 11, 2008 (DE) ..... 10 2008 047 319

(51) Int. Cl.
*B30B 9/32* (2006.01)
*B02C 4/08* (2006.01)
*B30B 3/00* (2006.01)

(52) U.S. Cl.
USPC ..... 100/98 R; 100/176; 100/902; 241/99; 241/158; 241/236

(58) Field of Classification Search
USPC ..... 100/94–97, 98 R, 99, 155 R, 172, 174, 100/176, 902; 241/99, 158, 166, 235, 236, 241/243
See application file for complete search history.

(56) References Cited

U.S. PATENT DOCUMENTS

| | | | | | |
|---|---|---|---|---|---|
| 4,009,838 | A * | 3/1977 | Tashman | 241/99 |
| 4,627,582 | A * | 12/1986 | Goldhammer | 241/236 |
| 4,669,673 | A * | 6/1987 | Lodovico et al. | 241/99 |
| 5,642,661 | A | 7/1997 | Tu | |
| 6,024,312 | A * | 2/2000 | Spiesshofer | 241/166 |
| 2006/0288886 | A1 * | 12/2006 | Schwelling | 100/902 |

FOREIGN PATENT DOCUMENTS

| | | |
|---|---|---|
| DE | 1005501 | 4/1957 |
| DE | 4338561 | 5/1995 |

* cited by examiner

*Primary Examiner* — Jimmy T Nguyen
(74) *Attorney, Agent, or Firm* — Horst M. Kasper

(57) ABSTRACT

An apparatus for compressing empty containers, in particular of beverage bottles or beverage cans made out of plastic, in particular out of polyethylene terephthalate PET, or tin plate. The apparatus has a cutting and pressing unit as well as means for driving and for controlling the cutting and pressing unit, wherein the cutting and pressing unit contains at least two cooperating, oppositely rotating rollers disposed at a distance relative to each other with respect to their rotation axes, wherein each roller has several disks in each case disposed towards each other with an axial distance (free space). According to a special further development it is proposed that at least in the operating region of the two rollers there are disposed axially next to each other a first working region for a compressing of containers made out of plastic and a second working region for a compressing of containers made out of metal.

20 Claims, 8 Drawing Sheets

DEVICE FOR COMPRESSING OF EMPTY DEFORMABLE CONTAINERS

CROSS-REFERENCE TO RELATED APPLICATIONS (not applicable)

Figure 1A:
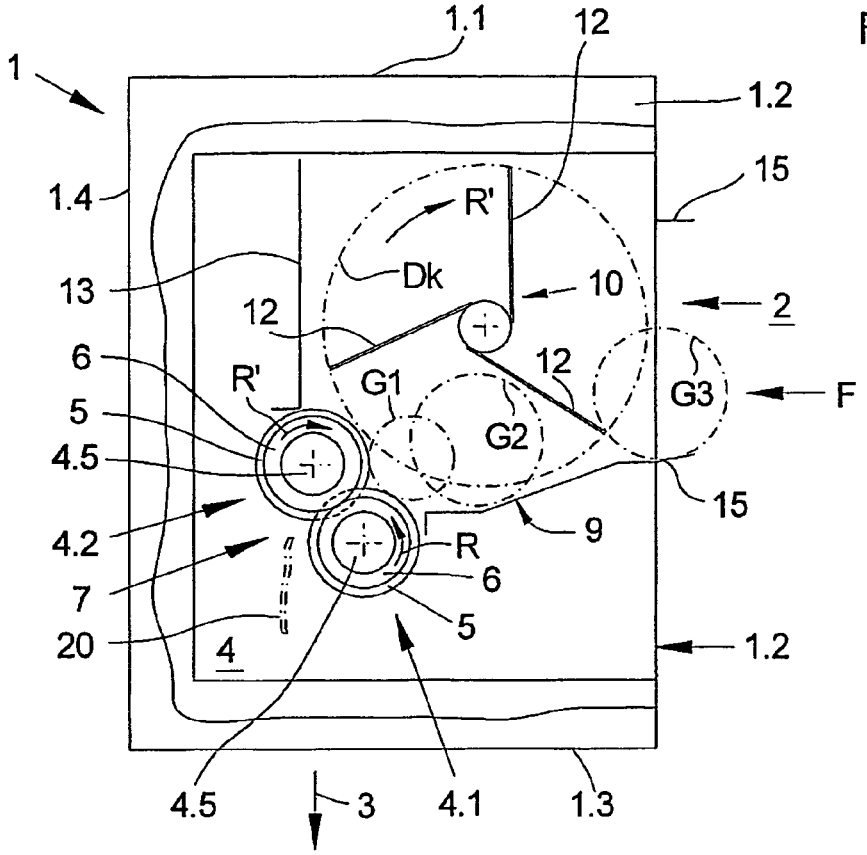

STATEMENT REGARDING FEDERALLY SPONSORED RESEARCH OR DEVELOPMENT (not applicable)

THE NAMES OF THE PARTIES TO A JOINT RESEARCH AGREEMENT (not applicable)

INCORPORATION-BY-REFERENCE OF MATERIAL SUBMITTED ON A COMPACT DISC (not applicable)

BACKGROUND OF THE INVENTION (1) Field of the Invention

The invention relates to a device for compressing empty containers, such as beverage bottles or beverage cans and similar waste materials.

(2) Description of Related Art including information disclosed under 37 CFR 1.97 and 1.98

Such devices are employed for compacting empty containers, in particular containers out of the food region, such as beverage bottles, cans and the like deformable containers, for transport to the recycling plants or, respectively, for the recycling process itself.

On the one hand, devices operating according to the principle of the plate pressing and on the other hand, such devices where the pressing unit/units contains/contain rollers. These devices are optimized either for the preparation of plastic containers or of tin plate containers/cans.

Since the recited waste materials can contain in a not unimportant number also closed containers, frequently a perforating press is predisposed to the pressing device/devices of these machines, for example a perforating press according to the German printed patent document DE 4338561 A1 or U.S. Pat. No. 5,642,661 A.

In order to be able to decrease the technical expenditure with these apparatuses, also apparatuses are known where means for perforating are furnished at press parts of the pressing devices, for example at a device for compacting of empty beverage containers according to the German printed patent document DE 1005501 A1. This device has a transport path essentially funnel shaped narrowing, into which path the beverage containers are run and are successively compacted under the effect of arrangements limiting the transport path on the side for transporting and compressing.

In addition, it is there provided that the rollers are furnished with blade shaped projections distributed over the circumference of the rollers, which projections extend over the length of the rollers, that is parallel to the rotation axis of the rollers. Furthermore and in particular the arrangements for transporting and compressing of the beverage containers at this device consist out of rollers driven with drum motors.

This arrangement is in particular expensive and service intensive because of the last recited device groups.

A further disadvantage is present were the distance of the pairwise arranged rollers, in particular those with the smallest distance of the axes, is not precisely adjusted with respect to the distance of the axes and the position of the there longitudinally directed blades. Then a separation of the materials fed through occurs such that smaller pieces are in each case generated from a bottle or can. Such smaller pieces if at all can only very poorly be processed to form bales; further containers are then necessary for the transport of the bales. In addition such smaller and smallest pieces are not always looked for in the further processing and frequently the further processing requires a plate shaped material.

As explained above, apparatuses known from the state-of-the-art can compress both empty and deformable containers out of plastic or out of tin plate/metal. The press units or, respectively, press and cutting units represent a compromise. Either they are optimized with respect to a high quality and/or quantity at the compressing of containers made of plastic, or for the compressing of containers made of metal; or a compromise is entered the with respect to both types of starting materials.

If thus compressed plastic containers as well as compressed metal cans in a high quality are to be present for further processing or, respectively, a high throughput is to be achieved in the apparatuses with respect to each of the two types of starting material, then in most cases a separate apparatus is required for each type of empty containers, with which apparatus in fact also the other type of empty containers can be compressed, but not in an optimal way. This fact entails among other things also a higher investment expenditure for the operator of such apparatuses.

Starting from this state of the art, a person of ordinary skill in the art is presented with the task to form an apparatus for compressing of empty containers, in particular beverage bottles or beverage cans made out of plastic, in particular polyethylene terephthalate PET-bottles, or tin plate such that the compressing of containers out of plastic as well as also out of metal/tin plate in a high quality and reliably is assured and that the production costs, operating costs, as well as the maintenance expenditure for this apparatus can be reduced relative to conventional apparatuses.

BRIEF SUMMARY OF THE INVENTION

This task is accomplished according to the present invention by an apparatus for compressing empty, deformable containers with the features of claim 1; advantageous embodiments and formations of the invention are subject matter of the dependent claims 2 through 15.

The core concept of the invention comprises that with the new apparatus with only a single roller pair with special axially oriented regions, the said containers out of plastic are compressible in a first working region and the said containers out of metal are compressible in a second working region, quasi simultaneous and next to each other.

The new apparatus for compressing empty containers, in particular beverage bottles or beverage cans made out of plastic, for example polyethylene terephthalate PET-bottles, or tin plate starts with a device according to the German printed patent document DE 103 25368 B4 (=U.S. Pat. No. 7,540,235 B2). The apparatus according to the present invention includes a cutting and pressing unit as well as means for driving and for controlling the cutting and pressing unit, wherein the cutting and pressing unit contains at least two cooperating and in opposite directions rotating rollers disposed at a distance relative to each other with respect to their rotation axes, and wherein each roller has several disks in each case disposed with an axial distance (free space) relative to each other. According to a special further development, it is proposed that at least in the effective region of the two rollers there is disposed a first working region for compressing of containers out of plastic and a second working region for compressing of containers out of metal, wherein the region of each roller coordinated to the first working region as well as the region of each roller coordinated to the second working region exhibits at least two sections with a different property, wherein the property of the sections in the first working region is different from the property of the sections in the second working region relative to the material of the fed in containers, wherein in particular the different property of the sections is defined by a different body form and shape or by differences in their body shapes.

The cutting and pressing unit is placed in a frame/housing with a filling opening as well as a discharge opening.

The new apparatus can in each case simultaneously be perforated/by region cut in or by region separated and compressed. The means for this purpose are formed such and disposed at each of the two (pressing) rollers and preferably integrated into the two (pressing) rollers, and are in particular a component of the bodies of the two (pressing) rollers themselves, wherein according to the procedure cut in wall sections of the wall sections of one container pressed at each other hook to each other during the through separating by section or, respectively, the cutting in of the flattened material and/or immediately succeeding, quasi in the final phase of such a cut. Herewith the expansion tendency of the container after the pressing is opposed, wherein the expansion tendency is determined by the original body shape of the container, the elasticity values of the material of container, and the pressing process. Wherein hooking is to be understood in the context of the present invention that longitudinal or cross sections/edge regions of a section in a wall of the compressed container with the corresponding longitudinal or cross edge of the concerned cut in section of the for this purpose oppositely disposed wall of the compressed container come to rest next to each other, without that partially the edges of the concerned cut in section project from the compressed, now essentially plate shaped body.

The means for compressing are furthermore such formed at least one of the rollers of the new apparatus and are disposed at the essentially parallel oppositely disposed positioned roller and in the position of the at least one of the rollers relative to the means for compressing, such that the outer face of the container, as seen in cross direction to the transport direction of the container, is at least sectionally beginning to be cut, or, respectively, at least slit slightly. Consequently tensions present in the material there are resolved and thus expansion tendencies of the container after the compressing are also opposed.

The preparation of containers made out of plastic, in particular polyethylene terephthalate PET-material, and of containers made out of tin plate in the said kind and fashion is enabled by the new apparatus without additional settings at the apparatus.

Preferably according to the present invention disks of different property are furnished at each roller, wherein the difference of the property is defined at least by the outer diameter of the disks in each case. The axial staggering of the two rollers in the assembled state is further such that at least two oppositely to each other disposed disks with the largest outer diameter are disposed next to each other and comb each other with their lateral faces disposed towards each other. In addition, this apparatus provides that the axial distance between neighboring disks in each case is produced by a radially directed turned groove.

According to a further preferred embodiment several axially oriented sections are disposed next to each other at each roller in each working region, wherein in each case disks of the same property are present in a section. It is in addition advantageous that next to each other disposed sections have in each case disks of different property, wherein in case of more than two sections in one work region, then sections with disks of different property are arranged alternating at each roller.

Further advantages result when the first working region has at least a first section with disks with smaller diameter—in the following also called pressing disks—and at least a second section with at least one disk with larger diameter—in the following also called cutting disks—.

In addition, the second working region can exhibit at least one third section with disks of a smaller diameter—in the following also called pressing disks—and at least one fourth section with at least one disk with a larger diameter—in the following also called crack disks. Here it is advantageous that the disks with smaller diameter are broader as compared with the disks with larger diameter. The distance between two axially neighboring disks with smaller diameter is fixed with a second turned groove, with a breadth for the combing engagement of the oppositely disposed disks with larger diameter plus cutting play on both sides. Here it is further advantageous that a third turned groove is furnished at each roller between one disk with larger diameter and a disk with smaller diameter, wherein the breadth of the third turned groove is smaller than the breadth of a disk with larger diameter.

Preferably the lengths of the sections with one or several disks of a larger diameter is smaller as compared with the length of the sections which have the disks with a smaller diameter.

Here it is especially further furnished that the disks of the second section, the cutting disks, have the largest diameter and the disks of the third section, the pressing disks, have the smallest diameter. The disks of the first section, the pressing disks, and the disks of the fourth section, the crack disks, have essentially approximately the same diameter, however not exactly the same diameter, wherein the diameter of the disks of the fourth section, the crack disks, are a little, approximately 0.5 to 3 percent larger than the diameter of the disks of the first section, the pressing disks.

It is furthermore of advantage that at least a groove is furnished in the circumferential face at least in the disks of the two working regions with the larger outer diameter, that is the cutting disks and the crack disks, wherein the groove passes through the two cutting disk flanks. At least the engagement and the gripping of the fed in containers through the cutting rollers is alleviated with this embodiment.

A further advantage with respect to a good quality (avoidance of white breaking positions in the compressed material as well as clean cuts and cracks) is achieved where the new apparatus is combined with reference to the formation of the groove with respective features of the device according to the German printed Patent document DE 19325368 B4 (=U.S. Pat. No. 7,540,235 B2). According to this special embodiment the in circulating direction lagging flank of the grooves disposed at least in the circumferential face of the cutting disk or, respectively, cutting disks forms an acute angled hook/tooth directed in circumferential direction with the circumferential face, wherein the flank (groove flank) starting at the tip, at least section wise, has a linear course directed opposite to the sense of rotation of the roller (of the circulating direction) and wherein the thereto following transition region towards the bottom of the groove and/or towards the flank disposed in circulating direction is formed bow shaped. Preferably the two flanks of each groove are aligned parallel to each other or divergent. The acute angle of the hook/tooth is preferably selected to be between 45 degrees and 80 degrees.

Further advantageous embodiments comprise that the so-called cutting play between neighboring cutting or cracking disks preferably has a value between 0.2 mm and 2 mm. In addition, in case of overlapping neighboring and oppositely disposed disks an overlap is selected between 0.5 mm and 2.5 mm, and preferably a value of 10 percent of the breadth of a disk.

The rotation speed of the rotating rollers is preferably 60 rotations per minute. It is also advantageous when a stripper is disposed between the disks, wherein in series produced strippers of paper shredders are employed, which strippers in each case do not grip completely around the core diameter of the respective roller. Here the applicant can rely on his own proven solutions. It is in addition provided that the starting pulse for the rollers for example is performed through a light barrier and that a lagging time is furnished.

Nozzles are furnished in the housing of the apparatus, for the admission of the rollers and/or of the inlet opening and the outlet opening with disinfectant. In addition the outer measurements of the apparatus are such that a coupling to a bottle receiver automat and/or to a can receiver automat can be performed.

The invention is illustrated more closely and further in the following description by way of advantageous embodiment examples schematically shown in the drawings.

BRIEF DESCRIPTION OF THE SEVERAL VIEWS OF THE DRAWING(S)

Figure 1B:
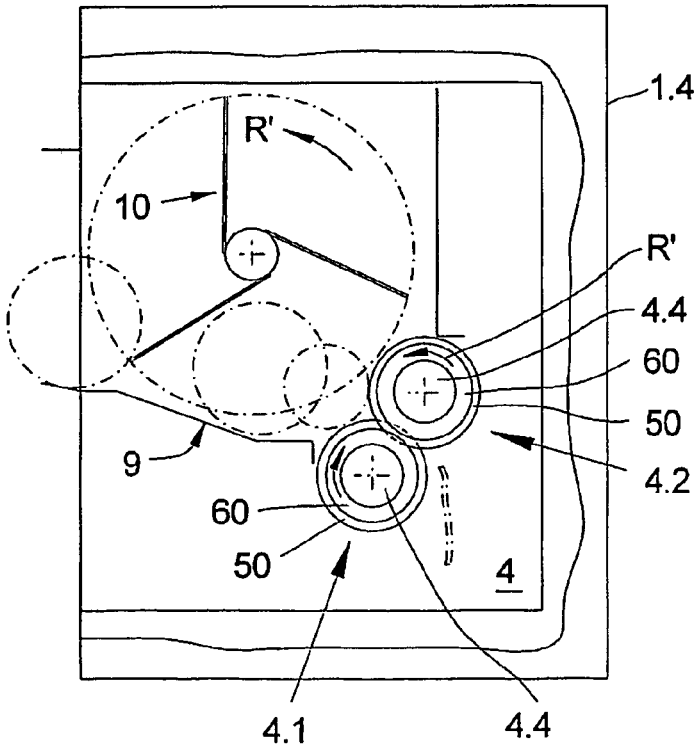
Figure 2:
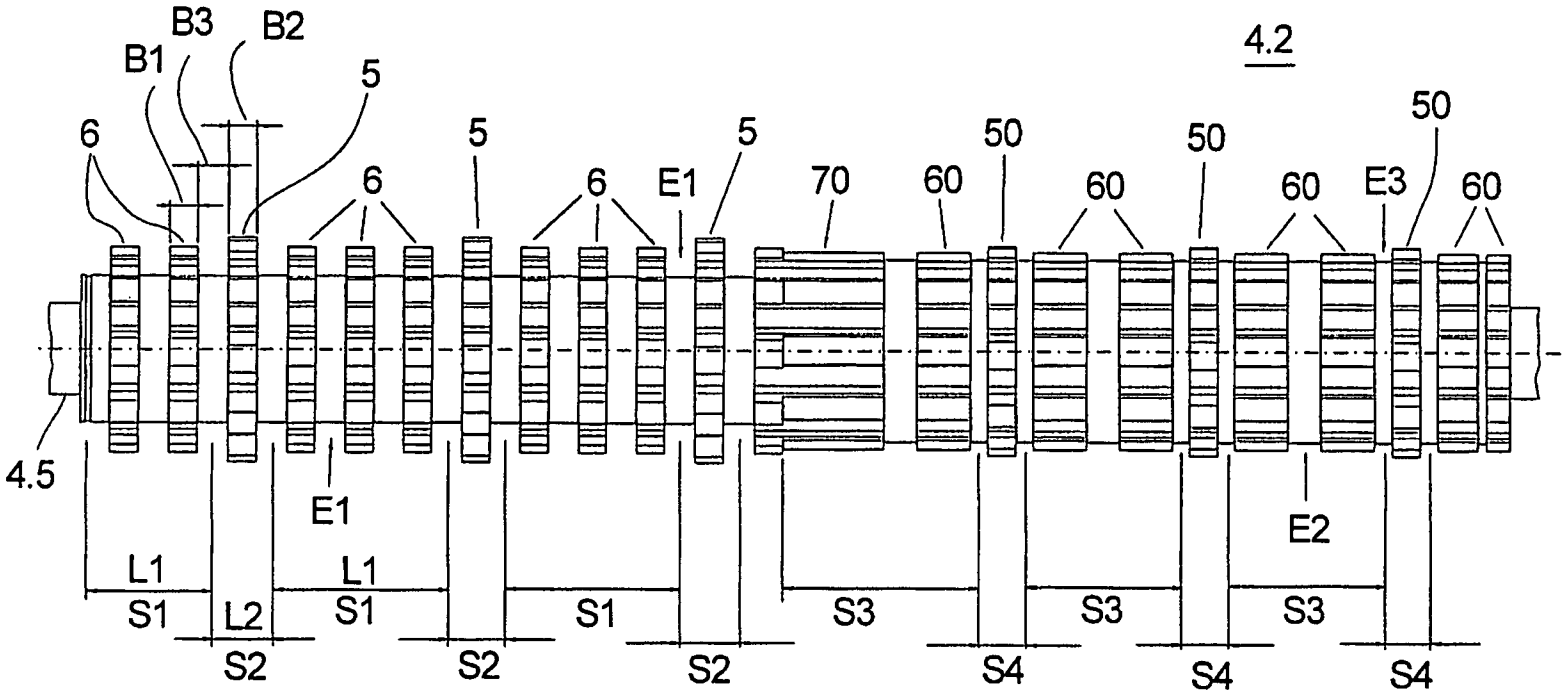
Figure 3A:
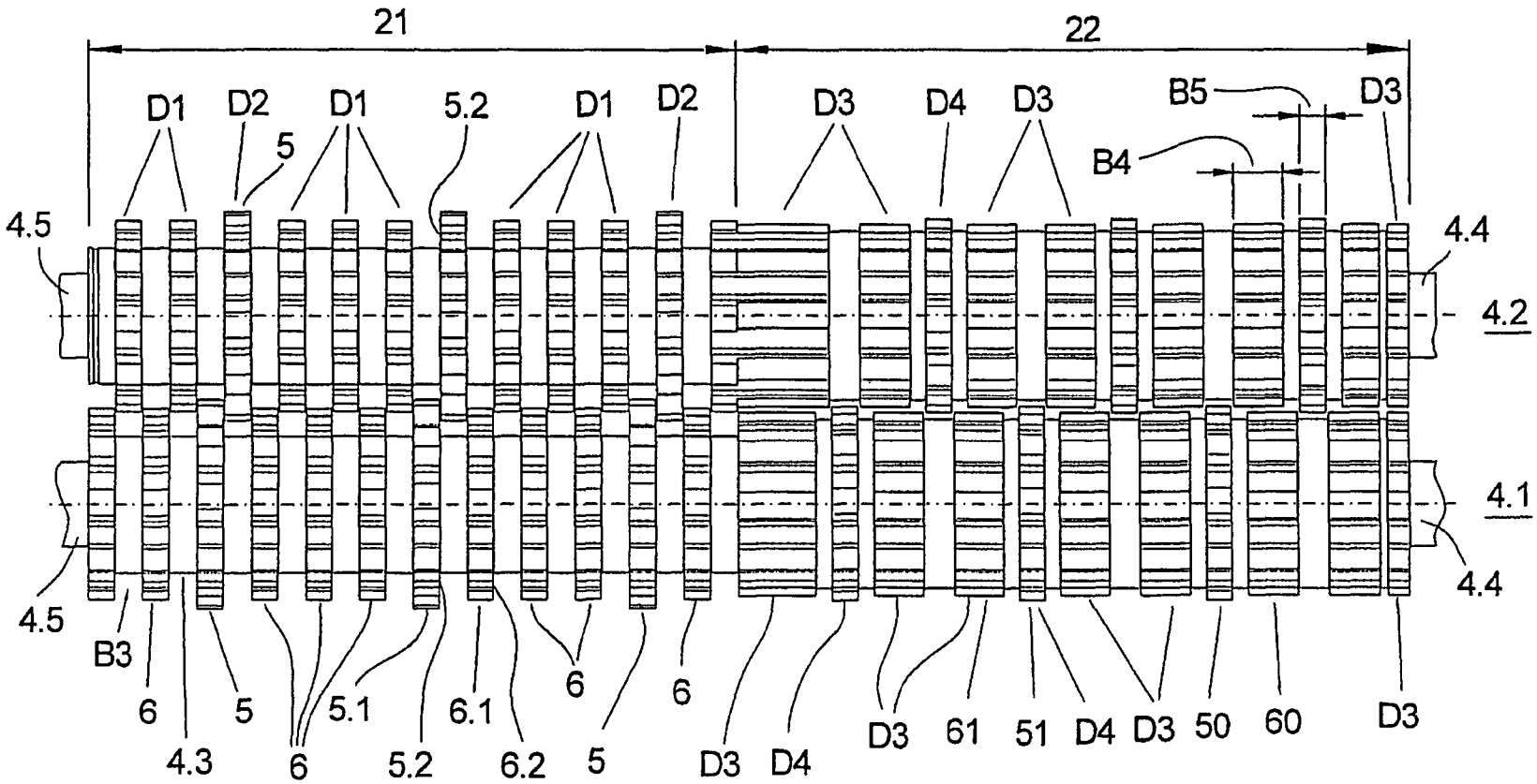
Figure 3B:
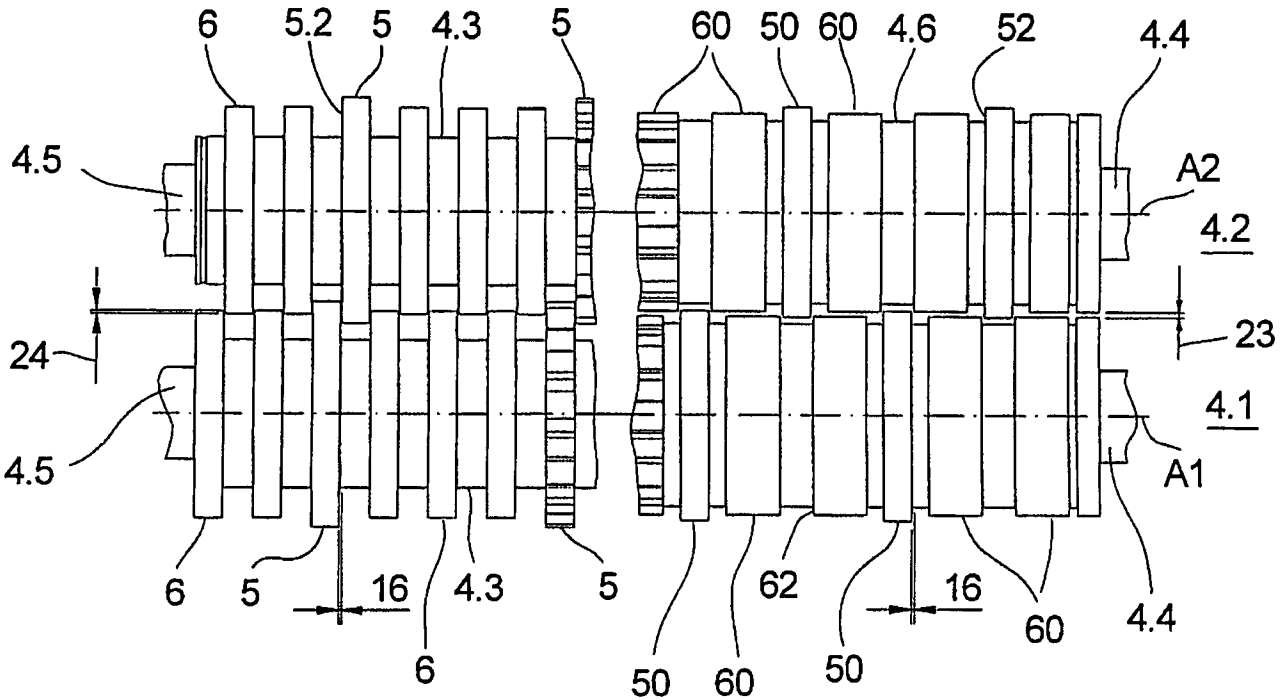
Figures 4A, 4B, 4C:
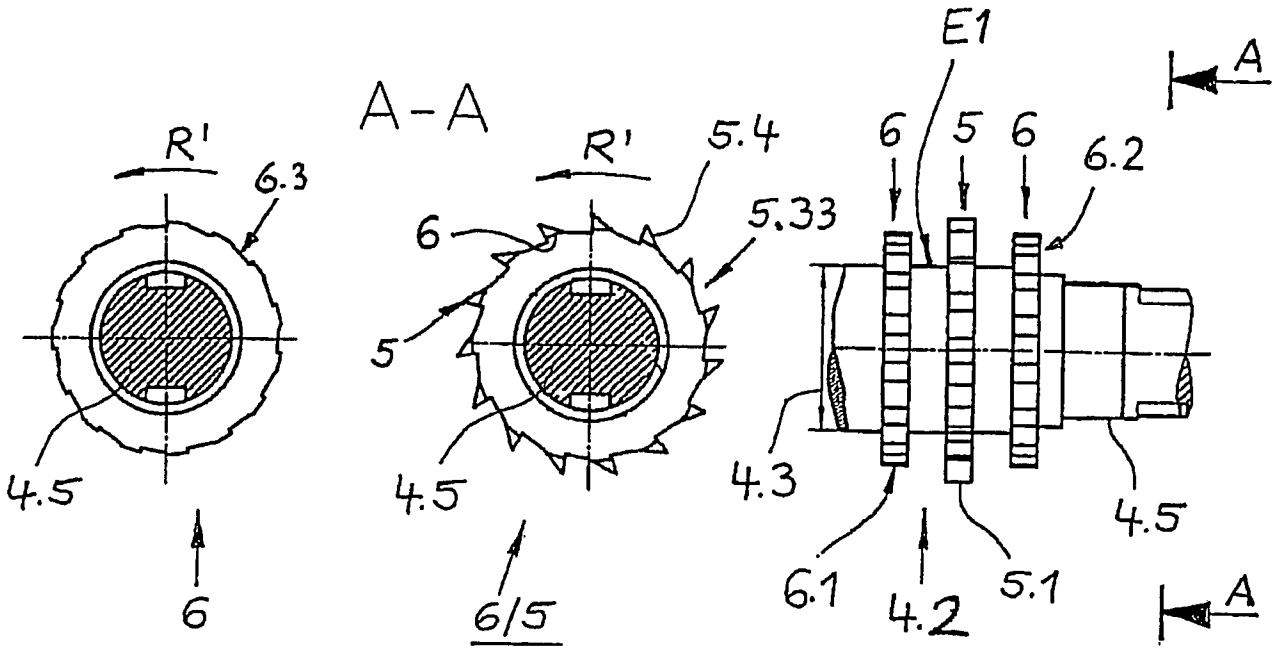

There is shown in:

FIGS. 1*a*, 1*b* an apparatus according to the present invention in each case in a lateral view with partially opened side face and view onto the cutting unit and the pressing unit;

FIG. 2 the upper roller of the cutting unit and pressing unit according to the FIG. 1 in an incorporated position and in a view from the direction of the filling opening;

FIG. 3*a* the position of the two rollers of the cutting unit and pressing unit relative to each other;

FIG. 3*b* the pair of cutting rollers according to FIG. 3*a* with further details;

FIG. 4*a* a view onto the drive side of one of the rollers;

FIG. 4*b* a front and relational view relative to FIG. 4*a;*

Figure 5:
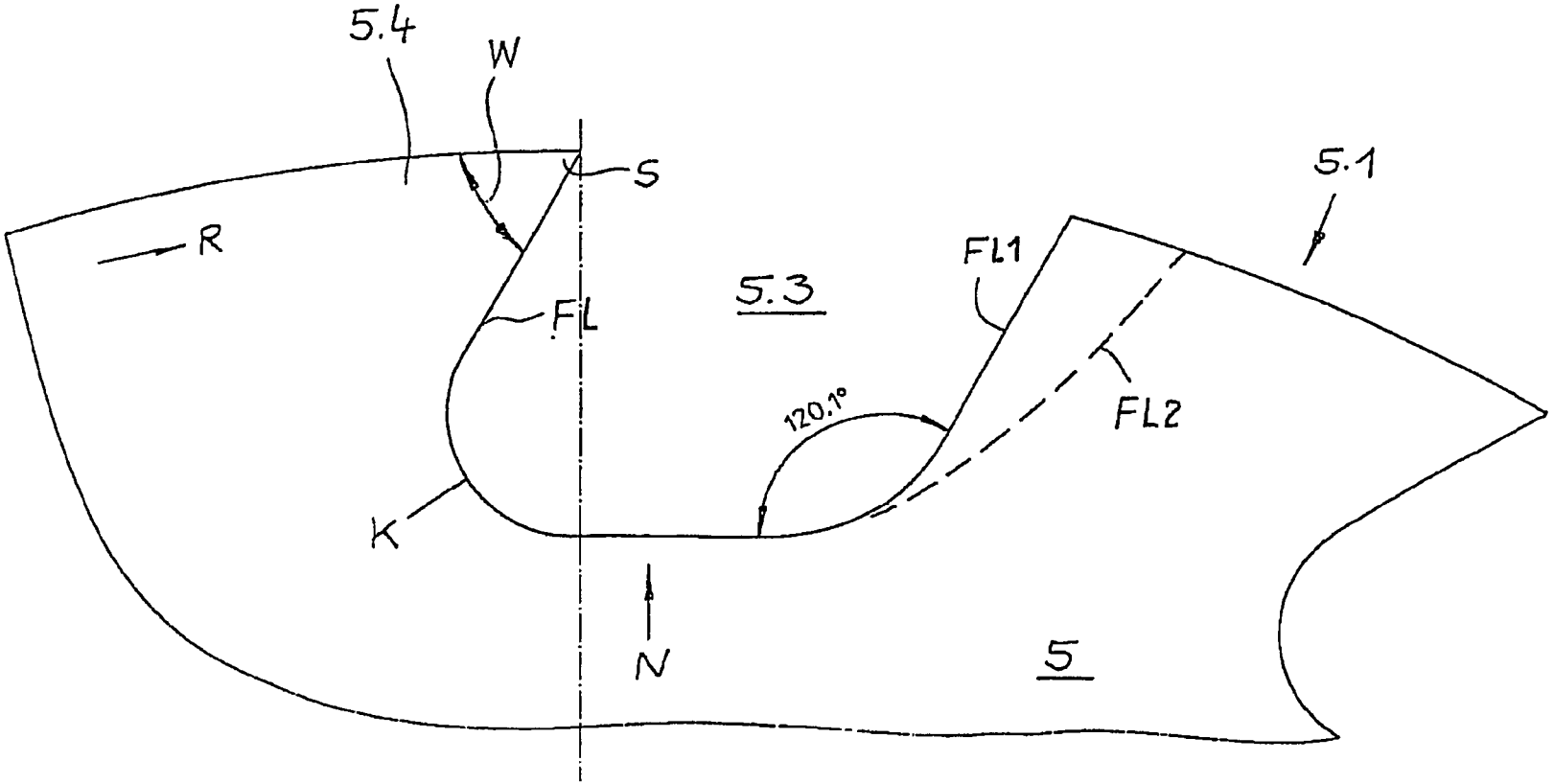
Figure 6:
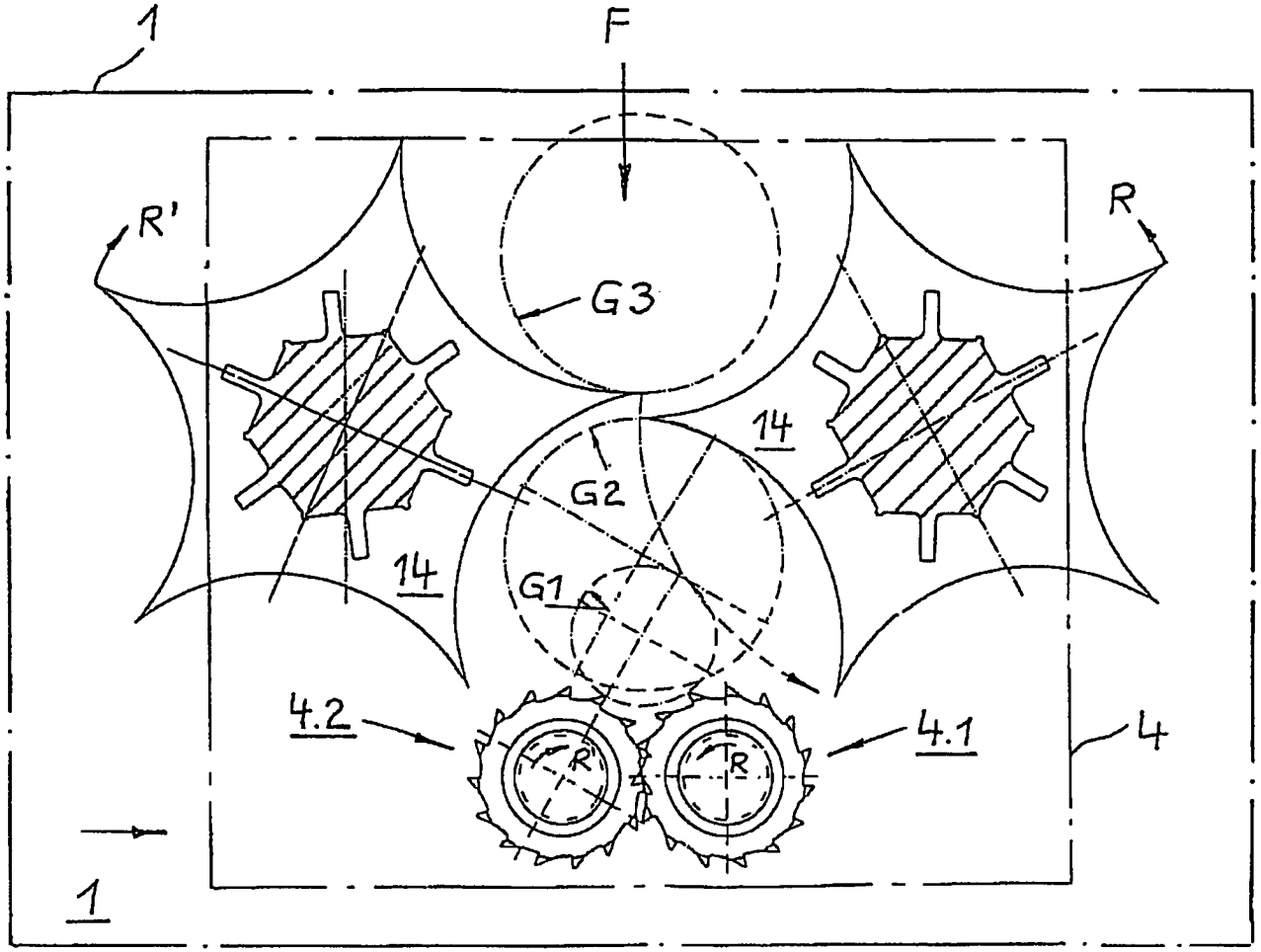

FIG. 4*c* a front elevational view of FIG. 4*a* without the cutting disk;

FIG. 5 a sectional view of a cutting disk with a special variation of the formation of the groove;

FIG. 6 a further variation of the separator predisposed to the rollers; and

Figure 7:
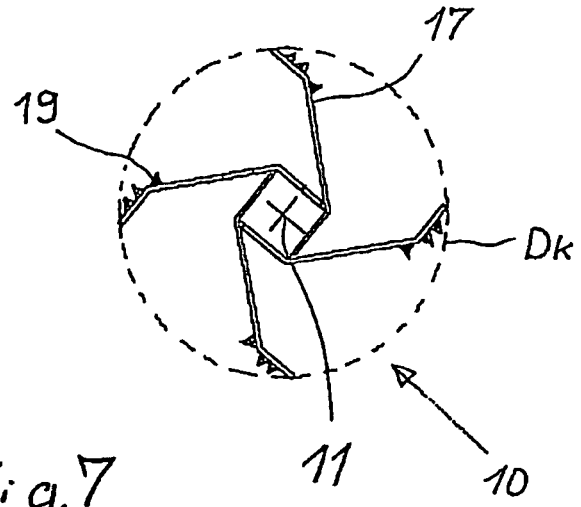
Figure 7A:
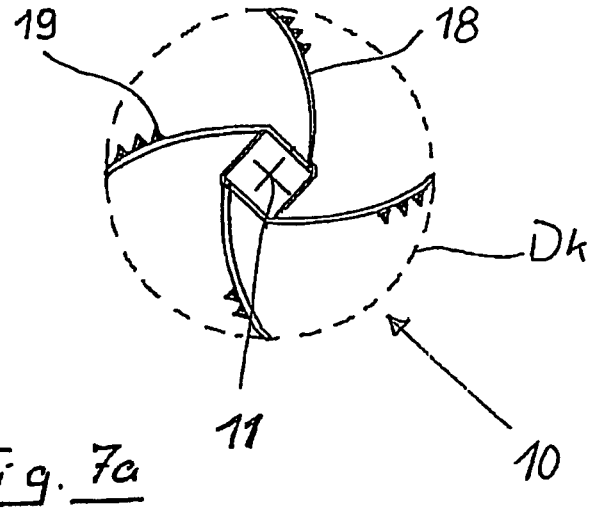

FIGS. 7 and 7*a* further details of the wings of the separator/metering unit of FIG. 1.

DETAILED DESCRIPTION OF THE INVENTION

The new apparatus for compressing of empty containers is shown in the figures 1*a* and 1*b* in each case in a lateral view and with partially opened side face and the view onto the cutting unit and pressing unit 4 shown schematically. The apparatus comprises here a housing 1, with a filling opening 2 in the front side 1.2 of the housing 1 as well as an output opening 3, also called outlet opening, in the lower side 3.1 of the housing 1 and a cutting unit and pressing unit 4 disposed in the housing 1 as well as means, here not shown, for driving and for controlling the cutting unit and pressing unit 4. The upper side 1.1 and the rear side 1.4 of the housing 1 are closed according to the embodiment example.

The cutting and pressing unit 4 comprises two rollers 4.1 and 4.2 disposed at a distance relative to each other and relative to their rotation axes A1, A2, compare FIG. 3*b*.

A sliding chute 9 is furnished from the lower edge of the filling opening to towards the cutting and pressing unit 4, wherein the fed in containers G3, G2, or G1 pass rolling or sliding to the unit 4. A separator 10 is positioned above this sliding chute 9 wherein the separator with its wings 12, here three wings, rotating around a rotation axis 11 feeds the containers G3, G2, or G1 to the unit 4 and simultaneously the separator presses the containers into the pull in slot of the cutting unit and pressing unit 4 at least to the capturing of the containers through their rollers 4.1, 4.2. The circumferential circle/operating circle described by the ends of the wings 12 is designated with Dk.

A plate like frame part 13 for limiting the receiver chamber is disposed above the cutting and pressing unit 4 and behind the separator 10. The region of the exiting of the items prepared in the cutting and pressing unit 4 is designated with the reference character 7.

According to a special construction it is furnished—compare FIG. 2 through FIG. 3*b*—that at least in the operating region of the two rollers 4.1, 4.2 the first working region 21 for compressing of the containers made out of plastic and the second working region 22 for compressing of the containers made of metal are arranged.

Each roller 4.1 and 4.2 exhibits at least two, preferably several, first sections S1, second sections S2, third sections S3, and fourth section S4 wherein disks successively alternating in the following sections S1, S2 or, respectively, S3, S4 in each case have a different outer diameter D1, D2 or, respectively, D3, D4, and wherein the two rollers 4.1 and 4.2 in the assembled state of the two rollers 4.1 and 4.2, at least the sections S2 exhibiting the larger outer diameter D2 are disposed staggered relative to each other and their disks 5 with their circumferential faces and their lateral faces 5.2 disposed towards each other are placed next each other partially combing (overlapping). The circumferential faces 5.1 of the cutting disks 5 have in each case at least one groove.

Preferably, the distance of the rotation axes A1, A2 of the rollers 4.1, 4.2 relative to each other is selected such that between the opposite to each other disposed disks 60, that is between their diameter D3 in each case there is present a distance 23 and between disks 6 disposed opposite to each other in the first working region 21 there is a distance 24 between their respective diameter D1. Here it is advantageous that the distance 23 there between the oppositely disposed disks 60 is larger in the second working region 22 for the compressing of containers made out of metal as compared with the distance 24 in the first working region 21. This distance 24 relative to the oppositely disposed disks 6 of the rollers 4.1 and 4.2 can also been negative with respect to the value amount.

The length L2 of the second sections S2 with disks 5 with the first larger outer diameter D2 is smaller as compared with the length L1 of the first sections S1, which first sections S1 have the disks 6 with the smaller outer diameter D1. The same holds analogously for the third sections S3 and for the fourth sections S4 with the disks 50 and 60.

The axial distance between the disks 6 themselves and the disks 5 is produced by radial inwardly directed turned grooves E1 having the breadth B3. The axial distance of neighboring disks 60 in the second work region 22 is produced in each case by a second turned groove E2 and the axial distance between the disks 60 and 50 is produced in each case through a third turned groove E3. The so-called cutting play 16 between neighboring disks 5 or, respectively, 5 and 6 as well as the disks 50 and 60, that is between their side faces 6.2 or, respectively, 5.2 as well as 52 and 62, compare FIG. 3*b*, has a value between 0.2 mm and 2 mm.

The breadth of the pressing disks 6 is designated as B1, the breadth of the cutting disks 5 is designated with B2, the breadth of the pressing disks 60 is designated with B4, and the breadth of the crack disks 50 is designated with B5. The overlap of neighboring and oppositely disposed cutting disks 5 here is selected in a value region between 0.5 mm and 2.5 mm, preferably this overlap amounts to 10 percent of the breadth of a disk 5 or, respectively, 6. The left end region of the roller 4.1 is formed in the FIGS. 2 through 3*b* as a bearing and drive pin 4.5 and the right end region is formed as a bearing pin 4.4. The disks of the rollers 4.1 and 4.2 are hardened and have a maximum hardness of 55 HRc.

Further details of the sections S1, S2, S3, and S4 as well as of the forming of the rollers are shown in the FIGS. 2 through 3*b*. The diameter D2 of the second section S2 amounts preferably to 77 to 79 mm, the diameter D1 of the first, smaller sections 51 amounts to 70 to 71 mm and the core diameter 4.3 in the first working region 21 of the rollers 4.1 and 4.2 amounts to from 50 to 62 mm and the core diameter 4.6 in the second working region 22 amounts to from 60 to 67 mm.

The diameter D4 of the fourth section S4 amounts to preferably 71 to 73 mm, the diameter D3 of the third, smaller sections S3 amounts to 67.5 to 70 mm.

The starting pulses for the rollers 4.1, 4.2 are performed preferably through a light barrier, which is not shown here; in addition also a trailing time is preset with this control part such that always all fed in containers leave the cutting unit and pressing unit. No container is disposed between resting rollers; adhesive attachments by a residual contents of the containers and unnecessary loading of the work regions of the cutting disks are avoided.

The illustrations of the strippers disposed between the disks 50, 60, and gripping in part around in each case the core diameters 4.3 or, respectively, 4.6 in the first E1, the second E2, and third E3 turned grooves/intermediate spaces have been dispensed with in the figures, preferably series production strippers of paper shredders are employed.

Embodiment examples for the detail forming of the cutting disks 5 and of the pressing disks 6 as well as the grooves disposed in the cutting disks 5 are shown in FIGS. 4*a* through 5. According to FIG. 5 the flank FL trailing in circulating direction R, R' of grooves 5.3 disposed in the circumferential face 5.1 of the cutting disks 5 form with the circumferential face 5.1 an acute angle hook 5.4 directed in circulating direction, wherein the groove flank FL beginning at the tip S has a linear course directed opposite to the sense of rotation R, R' of the rollers and the thereto following transition region K is formed like a bow to the bottom N of the groove and/or toward the groove flank FL1 or FL2. Preferably, the two groove FL and FL1 are running parallel to each other or divergent FL and FL2. The tip angle W of the book 5.4 is selected to be preferably between 45 degrees and 80 degrees.

The left section of the second rear roller 4.2 presented in FIG. 2 is shown in a mirror image in FIG. 4*a*. The bearing and drive pin provided at this end region is designated with reference position 4.5. A cutting disk 5 is flanked on two sides by a pressing disk 6. Grooves 6.3 or, respectively, 5.33 are disposed in the respective circumferential face 6.1 or, respectively, 5.1, which grooves break through at their side faces 6.2 or, respectively, 5.2.

A front view relative to FIG. 4*a* is shown in FIG. 4*b*, with a view onto the side face 6.2 and onto the hooks 5.4 of the there behind disposed cutting disk 5. A front elevational view of FIG. 4*a* is shown in FIG. 4*c*, wherein the cutting disk 5 was dispensed with in the production of the considered device part in order to be able to better reproduce the formation of the grooves 6.3 in the pressing disk 6. As schematically illustrated, the depth of the grooves 6.3 is substantially smaller relative to the depth of the grooves 5.3/5.33.

A further variation of the separator is shown in FIG. 6. This separator 14 has two star shaped shafts as seen in a side-(front-) view, wherein the sense of rotation R or, respectively, R' of the star shaped shafts is equal to that of the associated rollers.

Further variations of the wings of the separator 10 are illustrated in the FIGS. 7 and 7*a*. Starting with the center, the rotation axis 11, the wings are formed polygon like 17 or bow shaped 18 toward their free ends. These embodiments assure even better than the base variation, that the fed in containers, in particular containers with a volume between 0.25 liters and 3 liters receive an optimum pressure in the direction of the pulling slot of the cutting unit and pressing unit 4. As can be recognized further from these two figures, the end regions of the wings 17 or, respectively, 18 are occupied with prick elements 19. The tip of these prick elements 19 points in the direction of rotation, that is in working direction. This step still improves the holding and feeding of the containers to the pulling slot of the cutting unit and pressing unit 4. In particular with very thin walled and very flexible containers, under circumstances it can happen that the ends of the wings can slide over such a container. These prick elements 19 oppose such a tendency. Instead of being roughened with prick elements, the surfaces of the wings 17 or, respectively, 18 turned toward the respective container can be roughened or can have a rough coating.

Connecting sleeves 15 are furnished at the front side 1.2 in the region of the filling opening. The connecting sleeves 15 are applied there for the situation that the apparatus is to be coupled to a bottle and/or can receiver automat.

The above recited identified features of the drawing show in fact several preferred embodiments, however also other embodiments according to the present invention are considered as mentioned in the discussion. This disclosure offers illustrating embodiments according to the present invention as examples and not as limitations. A person of ordinary skill in the art can conceive numerous other modifications and embodiment constructions, which fall within the frame and the spirit of the principles of the present invention.

An embodiment structure also belongs to the invention, where grooves of the shape shown in FIG. 5 are worked into the circumferential faces 6.1, 51 or, respectively, 61 of the disks 6, 50, and 60. Here, it is economic with respect to production technology that initially the turned grooves are set and therewith the disks are formed, then the grooves are incorporated and only then the preconceived outer diameter D1, D2, D3, or, respectively, D4 is produced at the disks 5, 6, 50 and 60 concerned. This procedure can on the one hand refer to the complete shaft or in each case to the respective working region 21 and 22, such that the disks 5, 6 or, respectively, 50, 60 of these working regions 21 or, respectively, 22 have a different form of groove.

It falls also within the framework of the present invention that a combined disk 70 is furnished at least on one of the rollers in the transition region between the working regions 21 and 22. This combined disk has on the one hand a section according to the shape of the third disk 60 and on the other hand a section with the shape according to a first disk 6. In addition, it lies also within the framework of the present invention to further subdivide the first working region, which represents the region for the compressing of the empty containers out of plastic, for example in a sub region for white PET-bottles, a sub region for blue PET-bottles, and a sub region for green PET-bottles. The second working region, which represents the region for the compressing of containers made out of metal, is in the same way subdividable into a sub region for containers made out of tin plate and in a second sub region for containers made out of aluminum.

LIST OF REFERENCE CHARACTERS

1 frame/housing
1.1 upper side (face)
1.2 front side
1.3 bottom side
1.4 rear side
2 filling opening
3 discharge opening (output opening)
4 cutting unit and pressing unit
4.1 first roller (front)
4.2 second roller (rear)
4.3, 4.6 core diameter
4.4 bearing pin
4.5 bearing- and drive pin
5 cutting disks (second disks)
5.1 circumferential faces
5.2 side faces
5.3, 5.33 grooves
5.4 hooks
6 pressing disks (first disks)
6.1 circumferential face
6.2 side face
6.3 grooves
7 exit
9 slide chute
10 separator
11 rotation axis (of position 10)
12 wing
13 frame part (bordering of the receiver chamber toward the rear)
14 separator (selection engine)
15 connecting sleeve
16 cutting play
17 wing, like a polygon
18 wing, like a bow
19 prick elements (pointed screws, nails, or the like part)
20 compressed container
21 first working region
22 second working region
23 distance
24 distance
50 crack disks (fourth disks)
51 circumferential faces (of position 50)
60 press disks
61 circumferential faces (of position 60)
70 combined disk
A1 rotation axis of the roller 4.1
A2 rotation axis of the roller 4.2
B1 breadth of position 6
B2 breadth of position 5
B3 breadth of the turned groove E1
B4 breadth of the disks 60
B5 breadth of the disks 50
D1 diameter of the sections S1 (outer diameter)
D2 diameter of the sections S2 (outer diameter)
D3 diameter of the sections S3 (outer diameter of the respective disks)
D4 diameter of the sections S4 (outer diameter of the respective disks)
Dk circumferential circle of the wings according to FIG. 1
E1, E2, E3 turned grooves
F transport direction
FL flank (in circulating direction R or, respectively, R' lagging
FL1 flank (in circulating direction R or, respectively, R' lying, advancing)
FL2 flank (in circulating direction R or, respectively, R' lying, advancing)
N bottom of the groove
K transition region
W acute tip angle
G1, G2, G3 container, with different diameters
S tip of position 5.4
S1 first section (with disks of the same kind)
S2 second section (with disks of the same kind)
S3 third section (with disks of the same kind)
S4 fourth section (with disks of the same kind)
L1 length of the section S1
L2 length of this section S2
R circulating direction (direction of rotation, sense of roller rotation)
R' circulating direction (direction of rotation, sense of roller rotation)

The invention claimed is:

1. Apparatus for the compressing of empty, deformable containers, beverage bottles or cans made out of plastic polyethylene terephthalate PET-bottles or tin plate, with a cutting and pressing unit (4) and a device for driving and for controlling the cutting and pressing unit (4), the cutting and pressing unit (4) comprises at least two cooperating, oppositely rotating rollers (4.1 and 4.2) disposed at a distance to each other relative to their rotation axes(A1, A2), wherein each roller (4.1, 4.2) has several disks (5, 6; 50, 60, 70) disposed in each case at an axial distance to each other, wherein a first working region (21) and a second working region (22) extend axially along each of the two rollers (4.1, 4.2), wherein cutting disks (5) and pressing disks (6) of the disk in the first working region with their breadth (B1, B3) are always disposed opposite to first turned grooves (E1) of the neighboring roller (4.1, 4.2),wherein the turned grooves (E1) in the first working region (21) are always wider than disks(5, 6) in the first working region (21), wherein at least one press disk (60) in the second working region with its breadth (B4) is disposed opposite at least in part to a breadth (B4) of another press disk (60) in the second working region (22); wherein a first section (S1) is disposed at a first end of the rollers (4.1, 4.2) wherein a second section (S2) is adjoining the first section (S1) and thereby forming a first section pair, with additional first section pairs adjoining the first section pair up to a middle of the rollers (4.1, 4.2) and wherein a third section (S3) is disposed at a second end of the rollers (4.1, 4.2) and wherein a fourth section (S4) is adjoining the third section (S3) and thereby forming a second section pair, with additional second section pairs adjoining the second section pair up to the middle of the rollers (4.1, 4.2);

wherein a first pressing disk with a smaller diameter is associated with the first section (S1);

wherein a second cutting disk with a larger diameter is associated with the second section (S2);

wherein a third press disk with a smaller diameter is associated with the third section (S3);

wherein a fourth crack disk with a larger diameter is associated with the fourth section (S4);

a combined disk (70) furnished at least on one of the rollers in a transition region between the first section pair and the second section pair and having a section according to the diameter of the first pressing disk and a section according to the diameter of the third press disk, wherein the combined disk having a breadth wider than the breadths of the rest of the disks of the rollers;

wherein the first working region (21) has the first section (S1) with pressing disks (6) with a smaller diameter (D1) and the second section (S2) with the cutting disk (5) having a larger diameter (D2), and wherein in addition the second working region (22) has the third section (S3) with press disks (60) having a smaller diameter (D3) and the fourth section (S4) with at least one crack disk (50) with larger diameter (D4);

wherein the press disks (60) with smaller diameter (D3) are broader than the crack disks (50) with the larger diameter (D4) in the second working region (22); and wherein a third turned groove (E3) is disposed radially at each roller (4.1, 4.2) between a crack disk (50) with larger diameter (D4) and a press disk (60) with smaller diameter (D3), wherein the breadth of the smaller third turned groove (E3) is smaller than the breadth of the crack disk (50) with the larger diameter (D4).

2. Apparatus according to claim 1 wherein the first working region (21) and the second working region (22) subdivide in an axial direction along the first roller (4.1) and along the second roller (4.2), and wherein a distance (24) is negative in the first working region (21) and that the cutting and pressing disks (5,6) are overlapping disposed and wherein a distance (23) between the press disks (60) is formed positive.

3. Apparatus according to claim 2 wherein an axial staggering of the two rollers (4.1, 4.2) in the assembled state is such that at least two oppositely disposed to each other lying cutting disks (5) are disposed next to each other with the larger outer diameter (D2) and comb each other with their side faces (5.2) disposed toward each other.

4. Apparatus for compressing of empty, deformable containers, beverage bottles or cans made out of plastic, polyethylene terephthalate PET-bottles or tin plate comprising:

a cutting and pressing unit (4), a device for driving and for controlling the cutting and pressing unit (4), wherein the cutting and pressing unit (4) comprises at least a front roller (4.1) having a front axis (A1); a rear roller (4.2) having a rear axis (A2) disposed in parallel and at a distance to the front axis (A1), and the rear roller (4.2) cooperating with the front roller (4.1), and oppositely rotating to a rotation of the front roller (4.1), wherein a first working region (21) and a second working region (22) extend axially along each of the two rollers (4.1 and 4.2), and wherein each roller (4.1, 4.2) has several disks and grooves (50, 60, E2, E3), disposed in sequence relative to each other as follows for the front roller (4.1):

a) a first smaller diameter (60) and broader (D3) press disk (60) of the front roller (4.1), b) a broader second turned groove (E2) of the front roller (4.1), c) a second smaller diameter (60) and broader (D3) press disk (60) of the front roller (4.1), d) a narrower third turned groove (E3) of the front roller (4.1), e) a larger diameter (50) and narrower (D4) crack disk (50) of the front roller (4.1), f) a narrower third turned groove (E3) of the front roller (4.1), facing each other sequentially and followed by a like sequence beginning with a first smaller diameter (60) and broader (D3) press disk (60) of the front roller (4.1), and disposed in sequence relative to each other as follows for the rear roller (4.2):

a) a narrower, third turned groove (E3) of the rear roller (4.2), and facing the first smaller diameter (60) and broader (D3) press disk (60) of the front roller (4.1), b) a larger diameter (50) and narrower (D4) crack disk (50) of the rear roller (4.2), and facing the broader second turned groove (E2) of the front roller (4.1), c) a narrower third turned groove (E3) of the rear roller (4.2), and facing the second smaller diameter (60) and broader (D3) press disk (60) of the front roller (4.1), d) a second smaller diameter (60) and broader (D3) press disk (60) of the rear roller (4.2), and facing the narrower third turned groove (E3) of the front roller (4.1), e) a broader second turned groove (E2) of the rear roller (4.2), and facing a larger diameter (50) and narrower (D4) crack disk (50) of the front roller (4.1), f) a first smaller diameter (60) and broader (D3) press disk (60) of the rear roller (4.2), and facing the first narrower third turned groove (E3) of the front roller (4.1), facing each other sequentially and followed by a like sequence beginning with a narrower third turned groove (E3) of the rear roller (4.2), and the rear roller (4.2) further comprises a combined disk (70) located in a transition region between the first working region (21) and the second working region (22), wherein the combined disk having a breadth wider than the breadths of the rest of the disks of the rollers.

5. Apparatus according to claim 4, wherein the first working region (21) has a first section (S1) with pressing disks (6) with a smaller diameter (D1) and at least a second section (S2) with at least one cutting disk (5) having a larger diameter (D2), and wherein in addition the second working region (22) has at least one third section (S3) with press disks (60) having a smaller diameter (D3) and at least a fourth section (S4) with at least one crack disk (50) with a larger diameter (D4).

6. Apparatus according to claim 5, wherein the press disks (60) with smaller diameter (D3) are broader than the crack disks (50) with larger diameter (D4) in the second working region (22).

7. Apparatus according to claim 5, wherein the radially, body-inwardly directed third turned groove (E3) is furnished at each roller (4.1, 4.2) between axially neighboring press disks (60) of a smaller diameter (D3), the third turned groove (E3) having a breadth for the combing engagement of the oppositely disposed crack disk (50) with larger diameter (D4) as well as cutting play on two sides.

8. Apparatus according to claim 4 wherein the third turned groove (E3) is disposed radially at each roller (4.1, 4.2) between a crack disk (50) with larger diameter (D4) and a press disk (60) with smaller diameter (D3), wherein the breadth of the third turned groove (E3) is smaller than the breadth of the crack disk (50) with the larger diameter (D4).

9. Apparatus according to claim 5, wherein a length (L2) of the sections (S2) with one or several cutting disks of larger diameter (D2) is smaller as compared to a length (L1) of the sections (S1) having pressing disks with smaller diameter (D1).

10. Apparatus according to claim 9, wherein the pressing disks with sections (S1) exhibiting a smaller diameter (D1) have several pressing disks (6), wherein the pressing disks (6) are in each case at a distance of a breadth (B3) of a first turned groove (E1).

11. Apparatus according to claim 2, wherein a so-called cutting play (16) between neighboring, combing disks (5; 6; 50, 60) has a value of between 0.2 mm and 2 mm.

12. Apparatus according to claim 2, wherein the overlap of neighboring and oppositely disposed disks has a value of 10 percent of the breadth of the disk (5 or, respectively, 6; 50, 60).

13. Apparatus according to claim 3, wherein the cutting disks (5) exhibit grooves (5.3) worked into the circumferential face (5.1) of the cutting disks (5), wherein an opposing flank (FL) of grooves (5.3) trailing in circulating direction (R, R') forms an acute angled hook (5.4) pointing in circulating direction, wherein the opposing flank (FL) starting at a tip (S) has a linear course directed opposite to the circulation direction (R, R') and wherein a thereto following transition region (K) toward a bottom of the groove (N) and/or a first flank (FL1) disposed in the circulating direction are formed bow shaped, wherein the opposing flank (FL) and the first flank (FL1) of each groove run parallel to each other or diverging and wherein an acute angle (W) of a hook (5.4) is selected to be between 45 degrees and 80 degrees.

14. Apparatus according to claim 1, wherein a separator/selecting machine (10) is predisposed to the rollers (4.1, 4.2) of the cutting and pressing unit (4), wherein the separator/selecting machine (10) is a shaft with wings, wherein free ends of the wings are trailing relative to the start of the wings as seen in rotation direction (R') and wherein the wings attached in the center, that is at the rotation axis (11), are formed polygon like (17) or bow shaped (18) toward their free ends.

15. Apparatus according to claim 4, wherein a separator/selecting machine (10) is predisposed to the rollers (4.1, 4.2) of the cutting and pressing unit (4), wherein the separator/selecting machine (10) is a shaft with three or four wings (12), wherein free ends of the wings are trailing relative to the start of the wings as seen in rotation direction (R') and wherein the wings attached in the center, that is at the rotation axis (11), are formed polygon like (17) or bow shaped (18) toward their free ends.

16. Apparatus according to claim 2, wherein the overlap of neighboring and oppositely disposed disks has a value between 0.5 mm and 2.5 mm.

17. An apparatus for the compressing of empty, deformable containers, beverage bottles or cans made out of plastic or metal, comprising:

a cutting and pressing unit (4);

a device for driving and for controlling the cutting and pressing unit (4);

the cutting and pressing unit comprises a front roller (4.1) having a first rotation axis (A1) and a rear roller (4.2) having a second rotation axis (A2) cooperating with and rotating in an opposite direction to the front roller (4.1); wherein the second rotation axis (A2) is disposed at a distance to the first rotation axis (A1) a first working region (21) for compressing containers made out of plastic and extending axially along a first part of the first and second rotation axis (A1, A2);

a second working region (22) for compressing containers made out of metal and extending axially along a second part of the first and second rotation axis (A1, A2);

wherein each roller (4.1, 4.2) has several disks and grooves (50, 60, E2, E3), disposed in sequence relative to each other as follows for the front roller (4.1):

a) first smaller diameter (60) and broader (D3) press disk (60) of the front roller (4.1), b) a broader second turned groove (E2) of the front roller (4.1), c) a second smaller diameter (60) and broader (D3) press disk (60) of the front roller (4.1), d) a narrower third turned groove (E3) of the front roller (4.1), e) a larger diameter (50) and narrower (D4) crack disk (50) of the front roller (4.1), f) a narrower third turned groove (E3) of the front roller (4.1), facing each other sequentially and followed by a like sequence beginning with a first smaller diameter (60) and broader (D3) press disk (60) of the front roller (4.1), and disposed in sequence relative to each other as follows for the rear roller (4.2):

a) a narrower third turned groove (E3) of the rear roller (4.2), and facing the first smaller diameter (60) and broader (D3) press disk (60) of the front roller (4.1), b) a larger diameter (50) and narrower (D4) crack disk (50) of the rear roller (4.2), and facing the broader second turned groove (E2) of the front roller, c) a second narrower third turned groove (E3) of the rear roller (4.2), and facing the second smaller diameter (60) and broader (D3) press disk (60) of the front roller (4.1), d) a second smaller diameter (60) and broader (D3) press disk (60) of the rear roller (4.2), and facing the narrower third turned groove (E3) of the front roller (4.1), e) a broader second turned groove (E2) of the rear roller (4.2), and facing a larger diameter (50) and narrower (D4) crack disk (50) of the front roller (4.1), f) a first smaller diameter (60) and broader (D3) press disk (60) of the rear roller (4.2), and facing the first narrower third turned groove (E3) of the front roller (4.1), facing each other sequentially and followed by a like sequence beginning with a narrower third turned groove (E3) of the rear roller (4.2), and the rear roller (4.2) further comprises a combined disk (70) located in a transition region between the first working region (21) and the second working region (22), wherein the combined disk having a breadth wider than the breadths of the rest of the disks of the rollers.

18. The apparatus according to claim 17 wherein a length (L2) of a second section (S2) with a cutting disk (5) with the first larger outer diameter (D2) is smaller as compared with a length (L1) of a first section (S1), which first section (S1) has the pressing disk (6) with the smaller outer diameter (D1); and wherein a length (L4) of a fourth section (S4) with a crack disk (50) with a larger fourth outer diameter (D4) is smaller as compared with the length of a third section (S3), which third sections (S3) have the press disks (60) with the smaller outer diameter (D3).

19. The apparatus according to claim 17 wherein the first working region (21) has at least a first section (S1) with disks with smaller diameter also called first pressing disks and at least a second section (S2) with at least one disk with larger diameter also called cutting disk;

wherein the second working region (22) has at least a third section (S3) with disks of a smaller diameter also called third press disks, and at least a fourth section (S4) with at least one disk with a larger diameter also called crack disk;

wherein the disks of the second section (S2), the cutting disks, have a larger diameter and the disks of the third section (S3), the second pressing disks, have a smaller diameter;

wherein the diameter of the disks of the fourth section (S4), the crack disks, are approximately 0.5 to 3 percent larger than the diameter of the disks of the first section (S1), the first pressing disks.

20. The apparatus according to claim 17, wherein disks of different properties are furnished at each roller;

wherein the property is defined by the outer diameter of the disks in each case;

wherein the axial distance between neighboring disks in each case is produced by a radially directed turned groove;

wherein sections with disks of different property are arranged alternating at each roller;

wherein the first working region (21) has at least a first section (S1) with disks with smaller diameter also called pressing disks;

wherein at least one second section (S2) with at least one disk with a larger diameter also called cutting disk;

wherein the second working region (22) has at least a third section (S3) with disks with smaller diameter also called press disks;

wherein at least one fourth section (S4) is present with at least one disk with a larger diameter also called crack disk;

wherein the press disks with smaller diameter are broader as compared with the disks with the larger diameter;

wherein the distance between two axially neighboring press disks is fixed with the second turned groove;

wherein a third turned groove is furnished at each roller between the crack disk with larger diameter and the press disk with smaller diameter;

wherein the length of the fourth section with one or several crack disks of a larger diameter is smaller as compared with a length of the third section which has the press disks with a smaller diameter.

* * * * *